US005917461A

United States Patent [19]

Sakami et al.

[11] Patent Number: 5,917,461

[45] Date of Patent: Jun. 29, 1999

[54] VIDEO ADAPTER AND DIGITAL IMAGE DISPLAY APPARATUS

[75] Inventors: Hiroyuki Sakami; Hideki Maiguma, both of Hirakata, Japan

[73] Assignee: Matsushita Electric Industrial Co., Ltd., Osaka-fu, Japan

[21] Appl. No.: 08/847,593

[22] Filed: Apr. 24, 1997

[30] Foreign Application Priority Data

Apr. 26, 1996 [JP] Japan ..... 8-106684

[51] Int. Cl.[6] ..... G09G 1/06

[52] U.S. Cl. ..... 345/29; 345/213

[58] Field of Search ..... 345/29, 213, 115, 345/211, 212; 348/500, 536

[56] References Cited

U.S. PATENT DOCUMENTS

| | | | |
|---|---|---|---|
| 5,245,322 | 9/1993 | Dinwiddie, Jr. et al. | 345/115 |
| 5,526,017 | 6/1996 | Wilkie | 345/115 |
| 5,539,357 | 7/1996 | Rumreich | 331/17 |
| 5,579,028 | 11/1996 | Takeya | 345/115 |
| 5,805,233 | 3/1996 | West | 348/537 |

FOREIGN PATENT DOCUMENTS

| | | |
|---|---|---|
| 1237689 | 9/1989 | Japan . |
| 2245798 | 10/1990 | Japan . |
| 3100695 | 4/1991 | Japan . |
| 7-7703 | 5/1995 | Japan . |
| 7181043 | 7/1995 | Japan . |
| 9315497 | 8/1993 | WIPO . |

OTHER PUBLICATIONS

"Horizontal Centering Adjustment", pp. 551–552 in *IBM Technical Disclosure Bulletin,* vol. 37, No. 5 on May 1, 1994.

European Search Report in connection with European Application No. 97302872.3.

Patent Abstracts of Japan, vol. 95, No. 4, published on May 31, 1995.

Patent Abstracts of Japan, vol. 14, No. 574 (P–1145), published on Dec. 20, 1990.

Patent Abstracts of Japan, vol. 13, No. 570 (P–977), published on Dec. 18, 1989.

Patent Abstracts of Japan, vol. 15, No. 292 (P–1230), published on Jul. 24, 1991.

Patent Abstracts of Japan, vol. 95, No. 10, published Nov. 30, 1995.

*Primary Examiner*—Mark K. Zimmerman
*Assistant Examiner*—Ronald Laneau
*Attorney, Agent, or Firm*—Greenblum & Bernstein, P.L.C.

[57] ABSTRACT

A video adapter converts an analog image signal output from a personal computer to a digital signal. The clock frequency, phase data, and display position data for the A/D conversion are set automatically according to the analog image signal to adjust for any offset. An A/D converter analog/digital converts the analog image signal from a digital image signal source. An image start/termination coordinate detection circuit detects the video signal Sid start and end coordinates of the digital video signal from the A/D converter using the synchronization signals and clock, and then generates coordinate data. A clock generation circuit generates the clock input to the A/D converter based on the input from the display control circuit. A delay circuit delays the horizontal synchronization signal in the input analog image signal based on the phase data from the display control circuit and further outputs the result to the clock generation circuit. A display control circuit calculates the clock count data, phase data, and display position data for the image to be displayed based on the coordinate data.

6 Claims, 9 Drawing Sheets

VIDEO ADAPTER AND DIGITAL IMAGE DISPLAY APPARATUS

BACKGROUND OF THE INVENTION

1. Field of the Invention

The present invention relates to a video adapter for converting an analog video signal output from a personal computer or other video signal source to a digital video signal, and relates more specifically to a video adapter that compensates for variation in the clock frequency, phase timing, and display position of the converted digital video signal, and to a digital image display apparatus comprising said video adapter.

2. Description of the Prior Art

Raster scan analog displays based on a cathode ray tube (CRT) are most commonly used as the image display means of today's personal computers. The need to save space and reduce power consumption, however, has helped drive the development of digital image displays as a replacement for analog video signals. Typical of current digital displays is the flat panel display, which include liquid crystal displays, plasma displays, and cathode-type raster scan displays.

Image signals internally generated and processed by a personal computer, however, are digital signals. An internal or external video adapter has therefore been required to convert this digital signal to an analog signal for display on an analog display device.

This means that when a digital image display is used in place of the more conventional analog image display, an internal or external video adapter must be provided for the digital image display to reconvert the analog video signal output from the personal computer to a digital video signal. For convenience in the following discussion the video adapter used by the personal computer for analog-digital conversion is below referenced as the "output video adapter," and the video adapter used by the digital image display for digital-analog conversion is referenced as the "input video adapter."

The structure and operation of a conventional input video adapter VAc is described below referring to FIG. 10. This input video adapter VAc converts the analog video signal input from a personal computer to a digital video signal (A/D converts), and generates the digital image signal Sidc and display coordinate data Dco for controlling the digital image display.

As shown in FIG. 10 the input video adapter VAc comprises an A/D converter 1, clock generation circuit 2, delay circuit 5 display control circuit 14, and preset data memory 7. The analog image signal Sia and horizontal synchronization signal Hsync contained in the analog video signal are input to the A/D converter 1 and delay circuit 5, respectively. The clock generation circuit 2 is a phase-locked loop (PLL) circuit. The delay circuit 5 is achieved by means of a delay line or method using the delay value of each element in the gate array. The preset data memory 7 stores the image adjustment parameters PI, which is a set of predefined clock count data Dcl, phase data Dph, and display coordinate data Dco for every possible image resolution level of the analog video signal that may be input from the personal computer.

The display control circuit 14 outputs the clock count data Dcl to the clock generation circuit 2, the phase data Dph to the delay circuit 5, and the display coordinate data Dco to the digital image display by reading the image adjustment parameters PI corresponding to the image resolution of the analog image signal Sia by monitoring the frequency of the horizontal synchronization signal Hsync and the vertical synchronization signal Vsync of the input image signal.

Based on the supplied phase data Dph, the delay circuit 5 delays the horizontal synchronization signal Hsync a known period to change the signal phases and then outputs the result to the clock generation circuit 2.

The clock generation circuit 2 is a PLL circuit to which the clock count data Dcl from the display control circuit 14 is set. The clock generation circuit 2 operates at the frequency indicated by the clock count data Dcl to generate a clock CLK phase synchronized to the phase-shifted horizontal synchronization signal Hsync' output from the delay circuit 5, and outputs to the A/D converter 1.

The A/D converter 1 converts the analog image signal Sia to a digital image signal Sidc according to the timing of the clock CLK, and outputs to the display circuit (not shown in the figure) of the digital image display.

The image display is thus adjusted by reading the image adjustment parameters PI from the preset data memory 7 according to the image resolution of the analog video signal, and then outputting to the corresponding circuits. More specifically, the display control circuit 14 controls the clock CLK and the data phase relationship in the A/D converter 1 by outputting the phase data Dph (i.e., delay time) to the delay circuit 5. It should also be noted that an input means (not shown in the figures) connected to the display control circuit 14 is also provided so that the user can directly adjust the image adjustment parameters PI.

Note the image adjustment parameter PI data, specifically the clock CLK, display coordinate data Dco, and phase data Dph defined according to the clock, display, and phase timing of the analog video signal input from the personal computer, must be stored to the preset data memory 7 with the conventional input video adapter VAc described above. This means that image adjustment is not possible when an analog video signal with timing different from the timing of the image adjustment parameters PI stored to the preset data memory 7 is input, and the digital image display therefore cannot correctly display the image.

The output video adapters used with personal computers are also not completely standardized, and the timing of the analog video signals output by different video adapters and personal computers conforming to different standards often vary slightly from the "standard" timing. When this happens the clock count data Dcl, phase data Dph, and display coordinate data Dco read by the display control circuit 14 from the preset data memory 7 does not match the actually input analog video signal. This results in partial loss of or interference in the image displayed by the digital image display.

To compensate for such image flicker, jitter, or dropout the clock count data Dcl, phase data Dph, and display coordinate data Dco of the image adjustment parameters PI must be corrected according to the actually input analog video signal. This means that the user must operate keys, switches, or other input means while viewing the image displayed on the digital image display to manually adjust the image adjustment parameters PI stored in the preset data memory 7 according to the input analog video signal. This operation must be performed while visually monitoring the change in the image on a pixel level, and therefore requires both training and time. This actual image adjustment operation is described in detail below for the clock count data Dcl, phase data Dph, and display coordinate data Dco with reference to FIG. 11, FIG. 12, and FIG. 13.

Adjustment of the clock count data Dcl is described first. Note that the analog video signal input to the input video adapter VAc is assumed below to have been generated as a digital signal by a personal computer or other digital device. The original digital video signal is converted to an analog video signal using a D/A converter based on a dot clock synchronized to the horizontal synchronization signal Hsync. The converted analog video signal is supplied to a CRT monitor or other analog image display requiring an analog video signal input.

FIG. 11 shows the clock CLK and horizontal synchronization signal Hsync generated by the clock generation circuit 2. The dot clock is synchronized to the horizontal synchronization signal Hsync as described above. The A/D converter 1 sequentially converts the analog image signal Sia to a digital image signal Sidc based on the clock CLK. As a result the phase of the clock CLK must be synchronized to the phase of the horizontal synchronization signal Hsync to correctly display the image on LCD monitor or other digital image display.

Pulse Pc1 and Pcn of the clock CLK correspond to the pulse Ph1 and Ph2 of the horizontal synchronization signal Hsync where n is an integer greater than the horizontal resolution of the analog image signal Sia by a known amount. Pulse Ph1 and pulse Ph2 are positioned at the beginning and end of a particular horizontal scanning period Th. Note that the clock CLK and horizontal synchronization signal Hsync are synchronized if the starting time difference $\alpha$ and termination time difference $\beta$ are equal where the starting time difference $\alpha$ is the time difference between pulses Ph1 and Pc1 and the termination time difference $\beta$ is the time difference between pulses Ph2 and Pcn.

More specifically, adjusting the clock count data Dcl can be accomplished by changing the value of clock count data Dcl to synchronize the clock CLK to the horizontal synchronization signal Hsync, i.e., so that the difference T between starting time difference $\alpha$ and termination time difference $\beta$ equals zero ($Dcl=\alpha-\beta=0$). Whether starting time difference $\alpha$ and termination time difference $\beta$ are equal is determined by the user evaluating the quality of the image displayed on the monitor. This operation thus adjusts the offset T (Dcl) of the preset clock count data Dcl to the actual dot clock.

Adjusting the phase data Dph is described next.

The delay circuit 5 delays the horizontal synchronization signal Hsync supplied to the clock generation circuit 2 based on the phase data Dph input from the display control circuit 14. The clock generation circuit 2 generates a clock CLK phase synchronized to the delayed horizontal synchronization signal Hsync', and outputs to the A/D converter 1. The phase data Dph is thus a value specifying how much to delay the horizontal synchronization signal Hsync, and determines the timing whereby the A/D converter 1 converts the analog image signal Sia to a digital image signal Sid.

The analog image signal Sia, ideal clock CLKa, and actual clock CLKb are shown in FIG. 12. The ideal clock CLKa is the ideal timing pulse required to correctly A/D convert the analog image signal Sia. For example, if the A/D conversion timing is determined at the clock rise, the ideal clock CLKa has the rising edge Ea positioned at the middle of the pixel in the analog image signal Sia.

The phase of the actual clock CLKb, however, is shifted relative to the ideal clock CLKa, and the different T (Dph) is a maximum 180 degrees as shown in FIG. 12. In this case the rising edge Eb of the actual clock CLKb is positioned at the rise and the drop of the analog image signal Sia. A/D conversion is therefore processed around the unstable part of the analog image signal Sia, thus introducing interference to the image. To remove this interference, the actual clock CLKb must be delayed phase different T (Dph) to approach the ideal clock CLKa, or the phase difference data T (Dph) must be corrected.

To determine whether the actual clock CLKb is synchronized to the ideal clock CLKa, the user must evaluate the quality of the image displayed on the monitor. The offset T (Dph) of the preset phase data Dph of the clock CLK to the ideal clock CLKa is thus manually adjusted.

The display coordinate data Dco is described next.

The horizontal synchronization signal Hsync, analog image signal Sia, ideal image capture period Cp1, and the actual image capture period Cp2 of the image in the preceding line are shown in FIG. 13. The display coordinate data Dco determines the capture period CP of the analog image signal Sia. The analog image signal Sia also has an effective horizontal display period HEDP in the synchronization period of the horizontal synchronization signal Hsync. Note that the effective horizontal display period HEDP determines the horizontal space of the pixels to be displayed, i.e., the horizontal distance between the pixel at the left end and the pixel at the right end of the pixels displayed in each horizontal line displayed on screen. The ideal image capture period Cp1 matches the effective horizontal display period HEDP of the analog image signal Sia, resulting in all pixels being displayed.

The actual image capture period Cp2, however, is offset a specific period T (Dco) from the ideal image capture period Cp1. In other words, at the actual image capture period Cp2 the capture period CP and effective horizontal display period HEDP do not match, and the image is displayed on screen with image dropout of period T (Dco) at each edge.

To resolve this image dropout problem the actual image capture period Cp2 must be offset period T (Dco) closer to the ideal image capture period Cp1, or the display coordinate data Dco must be corrected so that the actual image capture period Cp2 matches the ideal image capture period Cp1.

In other words, whether the ideal image capture period Cp1 and the actual image capture period Cp2 match must again be determined by the user evaluating the image quality on the screen. The offset T (Dco) of the preset display coordinate data Dco of the actual image capture period Cp2 is thus manually adjusted to the ideal image capture period Cp1.

The object of the present invention is therefore to provide a method and apparatus for automatically adjusting the clock count data Dcl, phase data Dph, and display coordinate data Dco according to the actually input analog image signal Sia, thereby eliminating the training, practice, and time required by the prior art for manual adjustment of the data as described above.

SUMMARY OF THE INVENTION

The object of the present invention is therefore to provide a digital image display device and video adapter which solves these problems.

In order to achieve the aforementioned objective, a display device with a display adjustment apparatus for converting an analog image input signal to a digital signal for display according to the present invention comprises an analog/digital converter for converting the analog image signal input thereto to a digital signal based on an input analog-digital conversion clock signal, an image start/termination coordinate detection circuit for detecting the horizontal image start coordinate and the horizontal image termination coordinate in the horizontal period based on the clock input from the A/D converter and the horizontal synchronization signal Hsync and vertical synchronization signal Vsync, a display control circuit for calculating the clock count data from the horizontal image start coordinate and the horizontal image termination coordinate, and a clock generation circuit for generating the clock input to the A/D converter based on the clock count data input from the display control circuit. The display control circuit in this configuration automatically adjusts the frequency of the A/D conversion clock by computing the clock corresponding to the clock count of the A/D converter so that the difference of the horizontal image termination coordinate minus the horizontal image start coordinate matches the pixel count of the effective horizontal display period HEDP referenced for A/D conversion of the analog image signal.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

The preferred embodiments of the present invention are described below with reference to the accompanying figures.

The structure of a digital image display apparatus DD comprising an input video adapter VA according to the preferred embodiment of the present invention is described briefly below with reference to FIG. 1. The major components of this digital image display apparatus DD are the input video adapter VA, image display driving circuit 10, and image display 11.

The input video adapter VA (video adapter VA below) is connected to a digital image signal source (not shown), a personal computer in this embodiment, and generates a digital image signal Sid and display device control data Sdc based on the analog video signal supplied from the personal computer.

The image display driving circuit 10 is connected to the video adapter VA and generates the digital image driving signal SD driving the image display 11 based on the digital image signal Sid and display device control data Sdc supplied from the video adapter VA.

The image display 11 is connected to the image display driving circuit 10 and is driven according to the digital image driving signal SD supplied from the image display driving circuit 10. Note that the image display 11 can be a liquid crystal display (LCD) device, plasma display device, cathode type flat panel display, or other display device used for displaying images by means of a digital video signal.

Figure 1:
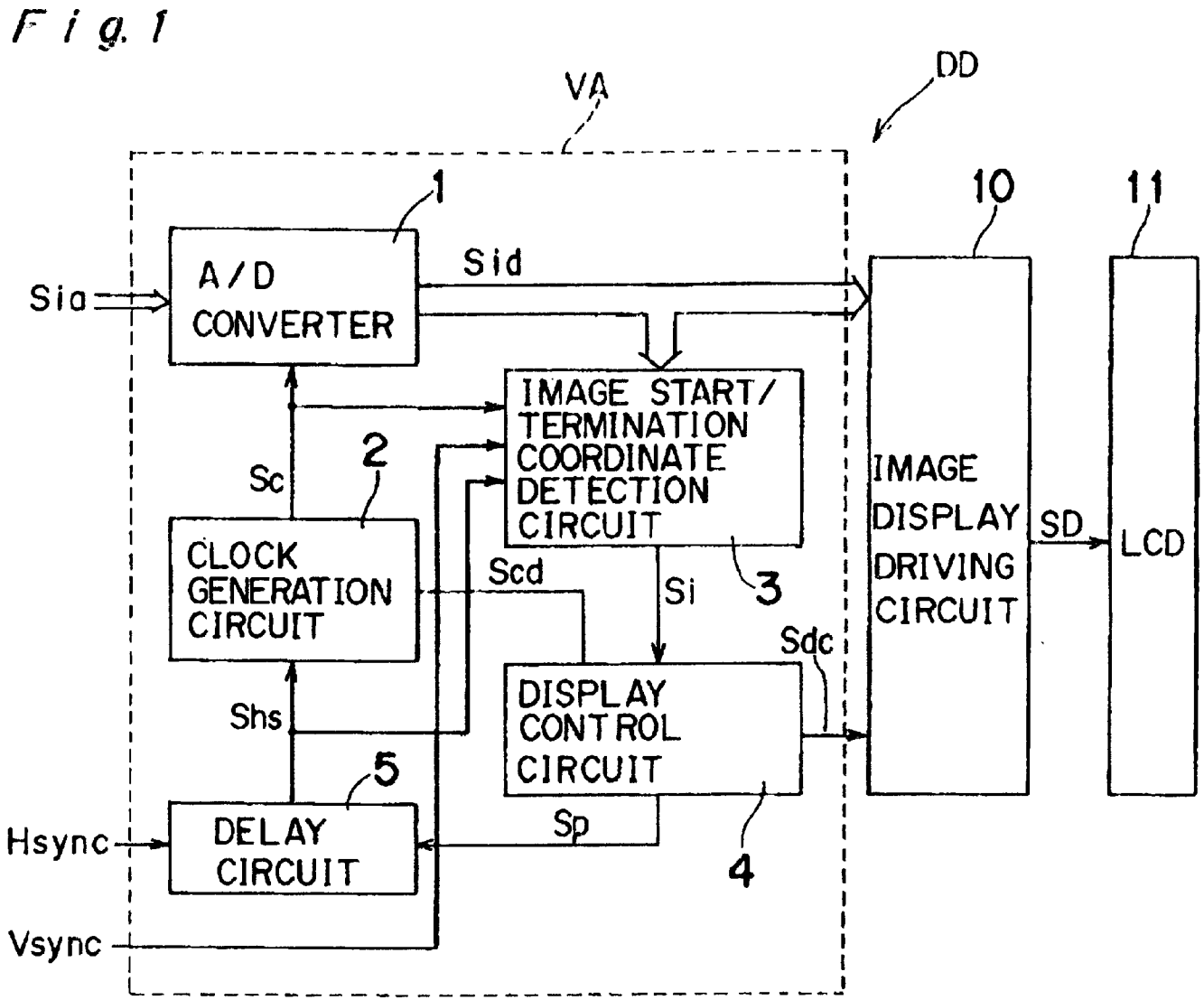
FIG. 1 is a block diagram of digital image display apparatus comprising an input video adapter according to a preferred embodiment of the invention.

The video adapter VA comprises an A/D converter 1, clock generation circuit 2, image start/termination coordinate detection circuit 3, display control circuit 4, and delay circuit 5 interconnected as shown in FIG. 1. The A/D converter 1, image start/termination coordinate detection circuit 3, and delay circuit 5 are connected to the personal computer (not shown in the figures) such that the analog image signal Sia, vertical synchronization signal Vsync, and horizontal synchronization signal Hsync in the analog video signal supplied from the personal computer are input respectively thereto.

The delay circuit 5 delays the horizontal synchronization signal Hsync a known period Ts based on the phase data Sp supplied from the display control circuit 4 as described below to generate the delayed horizontal synchronization signal Shs. The delayed horizontal synchronization signal Shs is then supplied to the clock generation circuit 2 and image start/termination coordinate detection circuit 3.

The clock generation circuit 2 generates a clock Sc phase synchronized to the delayed horizontal synchronization signal Shs and frequency adjusted to the clock count data Scd supplied from the display control circuit 4, and supplies the clock Sc to the A/D converter 1 and image start/termination coordinate detection circuit 3.

Based on this clock Sc, the A/D converter 1 converts the analog image signal Sia to a digital image signal Sid, and supplies the digital image signal Sid to the image start/termination coordinate detection circuit 3 and image display driving circuit 10.

Based on the digital image signal Sid from the A/D converter 1, the clock Sc from the clock generation circuit 2, the delayed horizontal synchronization signal Shs from the delay circuit 5, and the vertical synchronization signal Vsync from the personal computer, the image start/termination coordinate detection circuit 3 detects the horizontal and vertical start and termination coordinates of one frame of the digital image signal Sid, and generates the image information signal Si describing the image status. The precise method of generating this image information signal, Si is described below with reference to FIG. 7.

The display control circuit 4 generates the clock count data Scd, phase data Sp and display device control data Sdc based on the image information signal Si received from the image start/termination coordinate detection circuit 3. The precise operation of the display control circuit 4 is also described below with reference to FIG. 6.

The operation of the video adapter VA and digital image display apparatus DD is described next bellow with reference to FIG. 2. When an analog video signal comprising analog image signal Sia, horizontal synchronization signal Hsync, and vertical synchronization signal Vsync components is input from the personal computer, the video adapter VA generates the digital image signal Sid and display device control data Sdc according to the following procedure.

The first step #100 is to adjust the clock. This is accomplished by the display control circuit 4 generating the clock count data Scd according to the condition of the digital image signal Sid. Nots that this clock adjustment routine is described in detail below with reference to FIG. 6 and FIG. 7.

Phase adjustment in step #200 follows after clock adjustment is completed. This is accomplished by the display control circuit 4 generating the phase data Sp according to the condition of the digital image signal Sid. Note that this phase adjustment routine is described in detail below with reference to FIG. 8.

The next step #300 corrects the display position. The display control circuit 4 also accomplishes this step by generating the display device control data Sdc according to the condition of the digital image signal Sid. Note that this display position adjustment routine is described in detail below with reference to FIG. 9.

Based on the display device control data Sdc output by the display control circuit 4 in step #300, the image display driving circuit 10 processes the digital image signal Sid according to a defined image signal processing routine to generate the digital image driving signal SD for the digital image display apparatus DD in step #400.

In step #500 the image is correctly displayed based on the digital image driving signal SD output in step #400, and the process terminates.

Figure 2:
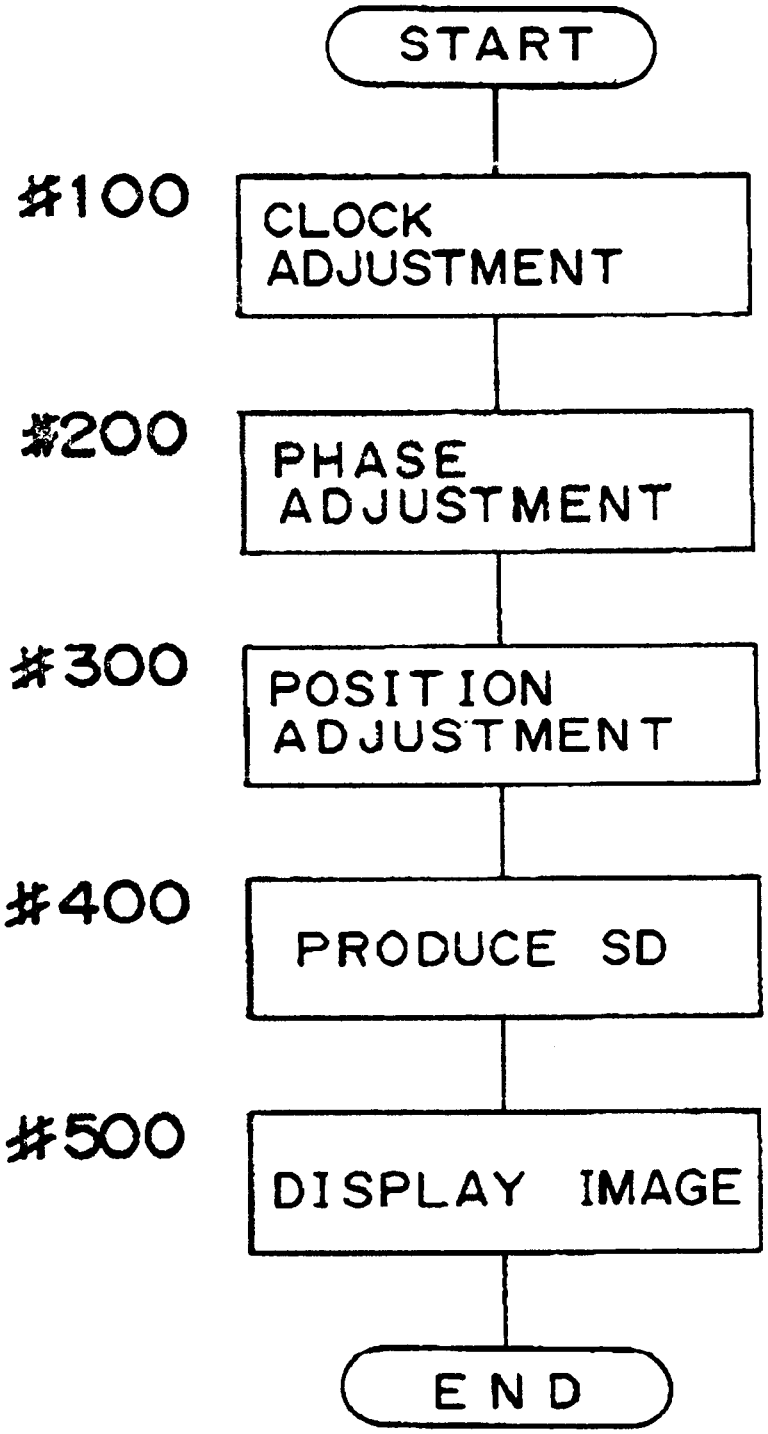
FIG. 2 is a flow chart used to describe the primary operation of the video adapter according to a preferred embodiment of the invention.

It should be noted that the process shown in FIG. 2 applies to image adjustment during digital conversion of the analog image signal Sia, but it this image adjustment process can also be used when the image resolution of the analog image signal Sia is changed. Calculation and automatic adjustment of the clock count data Scd, phase data Sp, and display device control data Sdc are described in sequence below.

Clock adjustment according to the present invention is described first below with reference to FIG. 3, FIG. 4, FIG. 6, and FIG. 7.

Figure 3:
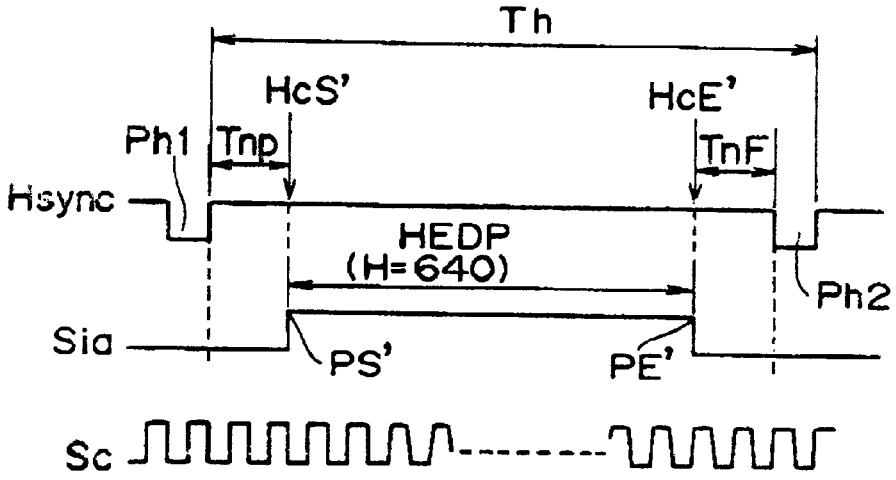
FIG. 3 is a waveform diagram used to describe clock adjustment by the present invention.

FIG. 3 is a waveform diagram of the horizontal synchronization signal Hsync, analog image signal Sia, and clock Sc in one horizontal line of the image. As shown in FIG. 3 the effective horizontal display period HEDP in which the horizontal line image is displayed is preferably positioned with good balance in the horizontal synchronization period Th of the horizontal synchronization signal Hsync of the analog image signal Sia.

More specifically, the effective horizontal display period HEDP of the horizontal line image is bracketed by a preceding no-display period Tnp and a following no-display period TnF in the horizontal synchronization period Th. The position of the effective horizontal display period HEDP can therefore be determined by detecting the line image starting pixel PS' and the line image ending pixel PE' of the effective horizontal display period HEDP in each line of the digital image signal Sid. This can be accomplished by evaluating each pixel of the digital image signal Sid A/D converted from the analog image signal Sia synchronized to the pulse of the A/D conversion clock Sc to determine whether the pixel contains image data. The horizontal position of the line image starting pixel PS' is then defined as the left horizontal line image coordinate HcS', and the horizontal position of the line image ending pixel PE' is defined as the right horizontal line image coordinate HcE'.

Image information for the horizontal pixel count, which is determined by the resolution of the image output through the output video adapter of the personal computer, is present in the effective horizontal display period HEDP. More specifically, the standard screen resolution of an image output from a video adapter conforming to the VGA video standard is 640 pixels wide (horizontal pixel count) by 480 lines (vertical pixel count) in the graphics mode. This means that image information for 640 pixels is contained in the effective horizontal display period HEDP. The effective horizontal display period HEDP can therefore be expressed by the horizontal pixel count H of the digital image signal Sid. Note also that the period between the pulses of the clock Sc to which operations are synchronized is the clock cycle.

The value of the clock count data Scd must be adjusted so that the clock Sc has 640 pulses in the effective horizontal display period HEDP in order to generate a digital image signal Sid containing image information for 640 pixels in the effective horizontal display period HEDP by A/D conversion of the analog image signal Sia.

Figure 4:
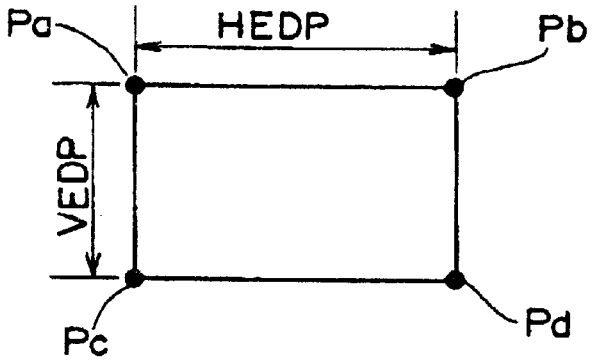
FIG. 4 is used to describe the image signal image information of the present inventions

Screen image FI whereby the image information of the analog image signal Sia is presented is shown in FIG. 4. This screen image FI is defined by the pixel matrix defined by the effective horizontal display period HEDP and the effective vertical display period VEDP. The top left, top right, bottom left, and bottom right pixels of this screen image FI are referenced below as corner pixel 1 Pa, corner pixel 2 Pb, corner pixel 3 Pc, and corner pixel 4 Pd, respectively.

Corner pixel 1 Pa is thus the starting point of both the effective horizontal display period HEDP and the effective vertical display period VEDP, i.e., the first pixel in the screen image FI. Corner pixel 2 Pb is the last pixel in effective horizontal display period HEDP at the beginning of the effective vertical display period VEDP, i.e. the last pixel in the first line of the raster image FI. Corner pixel 3 Pc is the first pixel in the effective horizontal display period HEDP at the end of the affective vertical display period VEDP, i.e., the first pixel in the last horizontal scan line V of the raster image FI. Corner pixel 4 Pd is thus the last pixel in both the effective horizontal display period HEDP and effective vertical display period VEDP, i.e., the last pixel in the last horizontal scan line V of the raster image FI. The pixels on the line joining corner pixel 1 Pa and corner pixel 3 Pc are thus the first pixel on each horizontal line, and the pixels on the line joining corner pixel 2 Pb and corner pixel 4 Pd are thus the last pixel on each horizontal line.

The analog image signal Sia contains the pixel values, i.e., image data, of corner pixel 1 Pa and corner pixel 3 Pc or corner pixel 2 Pb and corner pixel 4 Pd. The pixels containing a pixel value expressing such image information are the "valid display pixels." The display control circuit 4 supplies an appropriate clock value Pcv to the clock generation circuit 2 as the initial clock count data Scd. The image start/termination coordinate detection circuit 3 detects the valid display pixel at the left edge of the screen image FI of the digital image signal Sid output from the A/D converter 1 as the left image edge pixel PS, and detects the valid display pixel at the right edge of the screen image FI as the right image edge pixel PE.

The coordinates of the left image edge pixel PS can therefore be defined as (Hcs, Vcs) the coordinates of the right image edge pixel PE as (HcE, Vce), the coordinates of the line image starting pixel PS' as (HcS', VcS'), and the coordinates of the line image ending pixel PE' as (HcE', VcE'). The left image edge pixels PS are all line image starting pixels PS' in the screen image FI of which the left horizontal line image coordinate HcS' is on or closest to line Pa-Pc regardless of the vertical coordinate value. Likewise, the right image edge pixels PE are all line image ending pixels PE' in the screen image FI of which the right horizontal line image coordinate HcE' is on or closest to line Pb-Pd, regardless of the vertical coordinate value. The right edge of the screen image FI therefore refers to the line joining the right image edge pixels PE irrespective of the vertical position Vc of each horizontal line.

The horizontal period (distance) between the left image edge pixels PS and the right image edge pixels PE is defined as the horizontal image display period HP. The length of the horizontal image display period HP can be obtained by the equation |HcS−HcE|. The horizontal image display period HP and the effective horizontal display period HEDP of the digital image signal Sid must match.

The image start/termination coordinate detection circuit 3 comprises a register (not shown in the figures) for storing the line image starting pixel PS' and line image ending pixel PE' detected for each horizontal line Vc during the process of the invention as the temporary coordinates of the corresponding left image edge pixel PS and right image edge pixel PE.

The clock adjustment routine shown as step #100 in FIG. 2 is described below with reference to FIG. 6.

The clock adjustment routine starts with a system initialization operation in step S110. This initialization comprises two steps, S102 and S104.

In step S102 the image start/termination coordinate detection circuit 3 extracts the vertical pixel count V and the horizontal pixel count H, which together determine the image resolution of the digital image signal Sid. The line image starting pixel PS' and line image ending pixel PE' are then detected from the pixels in the first horizontal line after the vertical synchronization signal Vsync. In other words, the vertical position parameter Vc, which expresses which line starting from the first horizontal line the present image line is, is set to 1 where the start of the horizontal line is marked by from the input of pulse Ph1 of the horizontal synchronization signal Hsync. The vertical position parameter Vc is thus an integer less than or equal to the vertical pixel count V, and the horizontal position parameter Hc is an integer less than or equal to the clock pulse count corresponding to the horizontal synchronization period Th.

At step S104 the clock count data Scd is set to the initial clock value Pcv, the initial value of the clock counter PNC, which counts the clock Sc pulse synchronized to the clock Sc, is reset to zero (0), and the cached coordinate values of the left image edge pixel PS and right image edge pixel PE, and the line image starting pixel PS' and line image ending pixel PE', are reset to zero (0) As a result, the HcS, VcS, HcE, VcE, HcS', VcS', HcE', and VcE' values are set to 0.

The digital image signal Sid converted from the source analog image signal Sia by the A/D converter 1 is then input to the image start/termination coordinate detection circuit 3. After thus initializing the system in step S110, the procedure advances to step S120.

The horizontal image display period HP is detected in step S120 by determining for each pixel in each horizontal line Vc of the digital image signal Sid whether that pixel contains image information. The sequence for this determination is the raster scan sequence. Note that the method of detecting the horizontal image display period HP is described below with reference to FIG. 7. The procedure advances to step S170 after the horizontal image display period HP is obtained.

Figure 7:
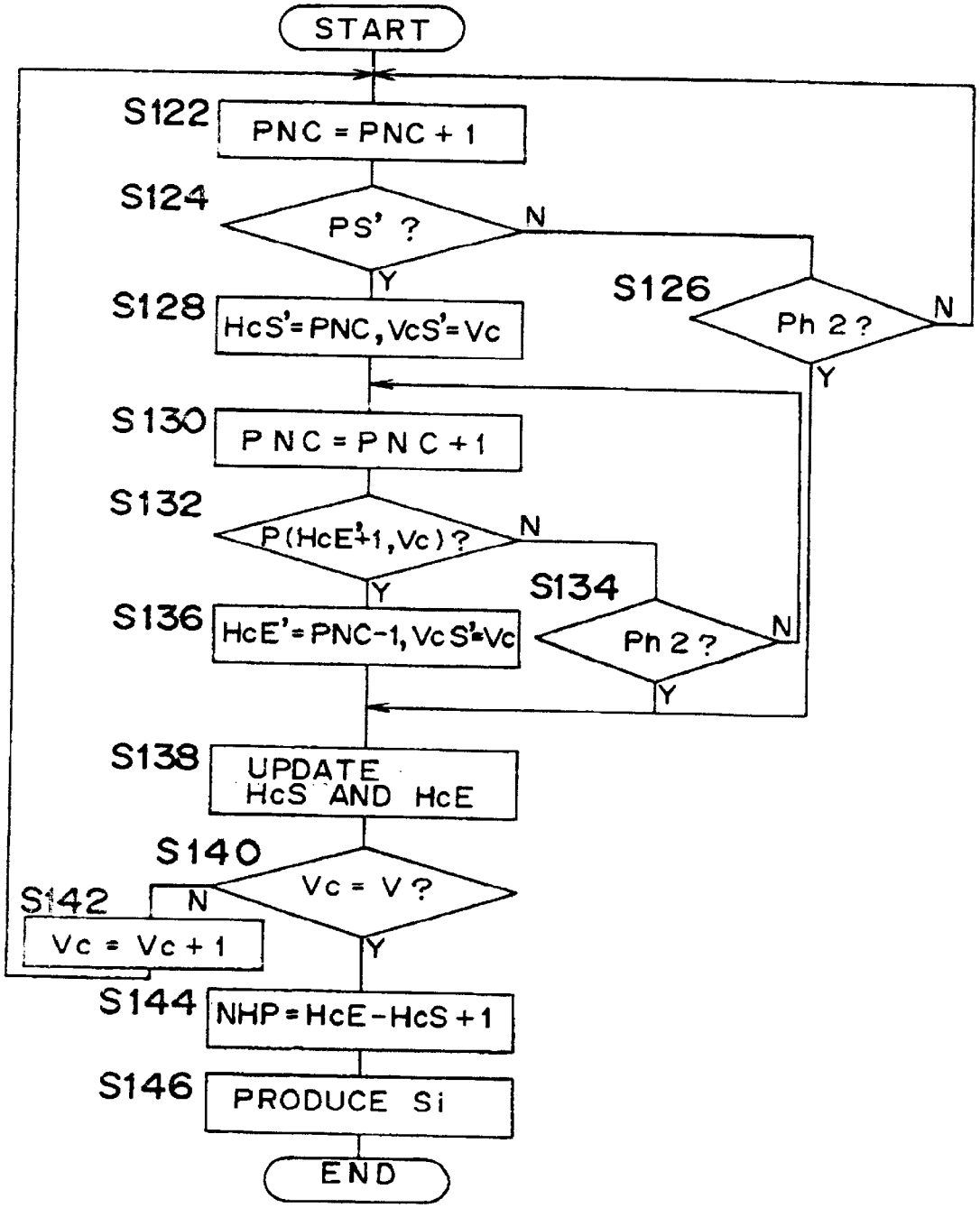
FIG. 7 is a detailed flow chart of the horizontal image display period pixel detection routine shown in FIG. 6.

Referring to FIG. 7, the clock counter PNC increments synchronized to each pulse of the clock Sc in step S122. This step defines the first pixel in the current horizontal line of the digital image signal Sid as the target pixel to be evaluated to determine whether it is a pixel in the effective display area of the image. The procedure then advances to step S124.

Whether the target pixel is the first valid display pixel in that line, i.e., is the line image starting pixel PS', is determined in step S124. As described, above there are no pixels that should be displayed in the preceding no-display period Tnp following pulse Ph1. As a result, NO is returned by step S124 in the preceding no-display period, Tnp, NO is also returned if the corner pixel 1 Pa being evaluated in this first loop is not a valid display pixel even if the pixel is within the effective horizontal display period HEDP. When NO is returned the procedure advances to step S126.

Step S126 determines whether the pulse Ph2 following the horizontal synchronization signal Hsync has been detected. By determining whether the clock pulse is pulse Ph2 it is possible to detect whether the line image starting pixel PS' evaluation has been executed for every pixel in the current horizontal line Vc. If the current target pixel P (PNC, Vc) is not the end of the current line, pulse Ph2 has not been detected. Step S126 therefore returns NO and the procedure loops back to step S122. This loop assures that the line image starting pixel PS' evaluation continues insofar as there are any unevaluated pixels left in the current horizontal line Vc.

As in the previous clock cycle, the clock counter PNC again increments synchronized to the clock Sc pulse when is step S126 loops back to step S122, thereby defining the next pixel in the line as the target pixel to be evaluated. As a result the loop of steps S122, S124, and S126 repeats each clock cycle until the line image starting pixel PS' is detected in step S124 or step S126 determines that all pixels in the current horizontal line have been evaluated.

When step S124 returns YES because the line image starting pixel PS' has been detected, the procedure advances to step S128. This is because once the line image starting pixel PS' has been detected it is not necessary to continue evaluating the remaining unevaluated pixels.

The line image starting pixel PS' of the current horizontal line Vc is then defined using the coordinates of the current target pixel in step S128. In other words, the current value of the clock counter PNC is set as the left horizontal line image coordinate HcS' the line. The procedure then advances to step S130.

As in step S122 the clock counter PNC increments in step S130 synchronized to the next pulse of the clock Sc. The next pixel is thus defined as the target pixel to be processed, and the procedure advances to step S132.

Step S132 determines whether the target pixel is first pixel following the line image ending pixel PE' in that line, i.e., is the last line image pixel P(HcE'+1, Vc). If the current target pixel P(PNC, Vc) is a valid display pixel, for example, NO is returned and the procedure advances to step S134. Step S132 thus effectively detects the last valid display pixel in that line.

As in step S126, seep S134 determines whether the pulse Ph2 following the horizontal synchronization signal Hsync has been detected. This step thus detects whether there are any pixels left in the current line to which the line image ending pixel PE' evaluation has not been applied. NO is thus returned if the current target pixel P(PNC, Vc) is not the last pixel in the line, and procedure loops back to step S130. The loop of steps S130, S132, and S134 is thus repeated each clock cycle until the line image ending pixel PE' is detected in step S132, i.e., the pixel after the line image ending pixel PE' is detected, or it is determined in step S136 that all pixels in the line have been evaluated.

If step S132 returns YES, confirming that the target pixel (PNC, Vc) is a pixel in the following no-display period TnF, the target pixel P(PNC, Vc) is confirmed to be the pixel P(HcE'+1, Vc) following the line image ending pixel PE', and the procedure advances to step S136. Control passes from the loop at this point because the target pixel P(PNC−1, Vc) in the preceding clock cycle was determined to be the line image ending pixel PE', and it is therefore not necessary to continue evaluating the remaining pixels in the line.

At step S136 the coordinates of the pixel detected during the previous clock cycle are set as the coordinates of the line image ending pixel PE' of the current horizontal line Vc. More specifically, PNC−1, the clock counter PNC value from the previous clock cycle, is set to the right horizontal line image coordinate HcE'. The procedure then advances to step S138.

Note that if step S126 returns YES because it is determined that there is no line image starting pixel PS' in the current horizontal line Vc, control passes directly to step S138 without initializing or updating the left horizontal line image coordinate HcS' value detected during the previous clock cycle in step S128.

Furthermore, if step S134 returns YES because it is determined that there is no line image ending pixel PE' in the current line, the right horizontal line image coordinate HcE' value of the line image ending pixel PE' detected in the previous clock cycle are neither updated nor initialized in step S136, and the procedure advances to step S138.

The coordinates of the left image edge pixel PS and right image edge pixel PE stored to a register are then updated in step S138 based on the line image starting pixel PS' and line image ending pixel PE' values obtained for the current horizontal line Vc after passing steps S126, S134, and S136. The process executed in step S138 is described below.

The method of updating the left image edge pixel PS is described first. If the left horizontal line image coordinate HcS' of the newly detected line image starting pixel PS' is less than the horizontal image start coordinate HcS of the left image edge pixel PS stored to the register, the left horizontal line image coordinate HcS' of the current line image starting pixel PS' is stored as the horizontal image start coordinate HcS of the left image edge pixel PS to the register. More specifically, the horizontal coordinate of the first valid display pixel of each horizontal line in the screen image FI detected in the raster scan sequence is defined as the horizontal image start coordinate HcS at that point.

Updating the right image edge pixel PE is described next. If the value of the right horizontal line image coordinate HcE' of the newly detected line image ending pixel PE' is greater than the horizontal image termination coordinate HcE of the left image edge pixel PS stored to the register, the right horizontal line image coordinate HcE' of the current line image ending pixel PE' is stored to the register as the horizontal image termination coordinate HcE of the right image edge pixel PE. The horizontal coordinate of the last valid display pixel on each horizontal line of the screen image FI detected in raster scan sequence is thus defined as the horizontal image termination coordinate HcE at that point.

The horizontal coordinates of the line image starting pixel PS' and line image ending pixel PE' obtained line by line are thus compared with the horizontal coordinates of the left image edge pixel PS and right image edge pixel PE stored to the register and updated appropriately to obtain the horizontal coordinate HcS of the pixel PS at the left edge and the horizontal coordinate HcE of the pixel PE at the right edge of the overall screen image FI from the first horizontal line V1 to the current horizontal line Vc. The procedure then advances to step S140.

It is then determined whether the vertical position parameter Vc is equal to the vertical pixel count V at step S140. If the vertical position parameter Vc has not been incremented to the last horizontal line V of the screen image FI, NO is returned and the procedure advances to step S142.

At step S142 the vertical position parameter Vc is incremented one to increment the horizontal line being evaluated to the next horizontal line. The procedure then advances to step S122.

However, if step S140 returns YES because the left image edge pixel PS and right image edge pixel PE values were updated using the coordinates obtained after evaluating all horizontal lines in the screen image FI, the procedure advances to step S144.

The pixel count NHP of the horizontal image display period HP is obtained in step S144 by subtracting the horizontal images start coordinate HcS from the horizontal image termination coordinate HcE detected for the entire screen image FI in stop S138, and adding 1. The procedure then advances to step S146. It should be noted that the pixel count NHP of the horizontal image display period HP is calculated in this step using the following equation.

$$NHP=HcE-HcS+1 \quad [1]$$

The image information signal Si is then generated in step S146 based on the information detected in step S138 and step S144 by the image start/termination coordinate detection circuit 3. The image start/termination coordinate detection circuit 3 then outputs this image information signal Si to the display control circuit 4.

Figure 6:
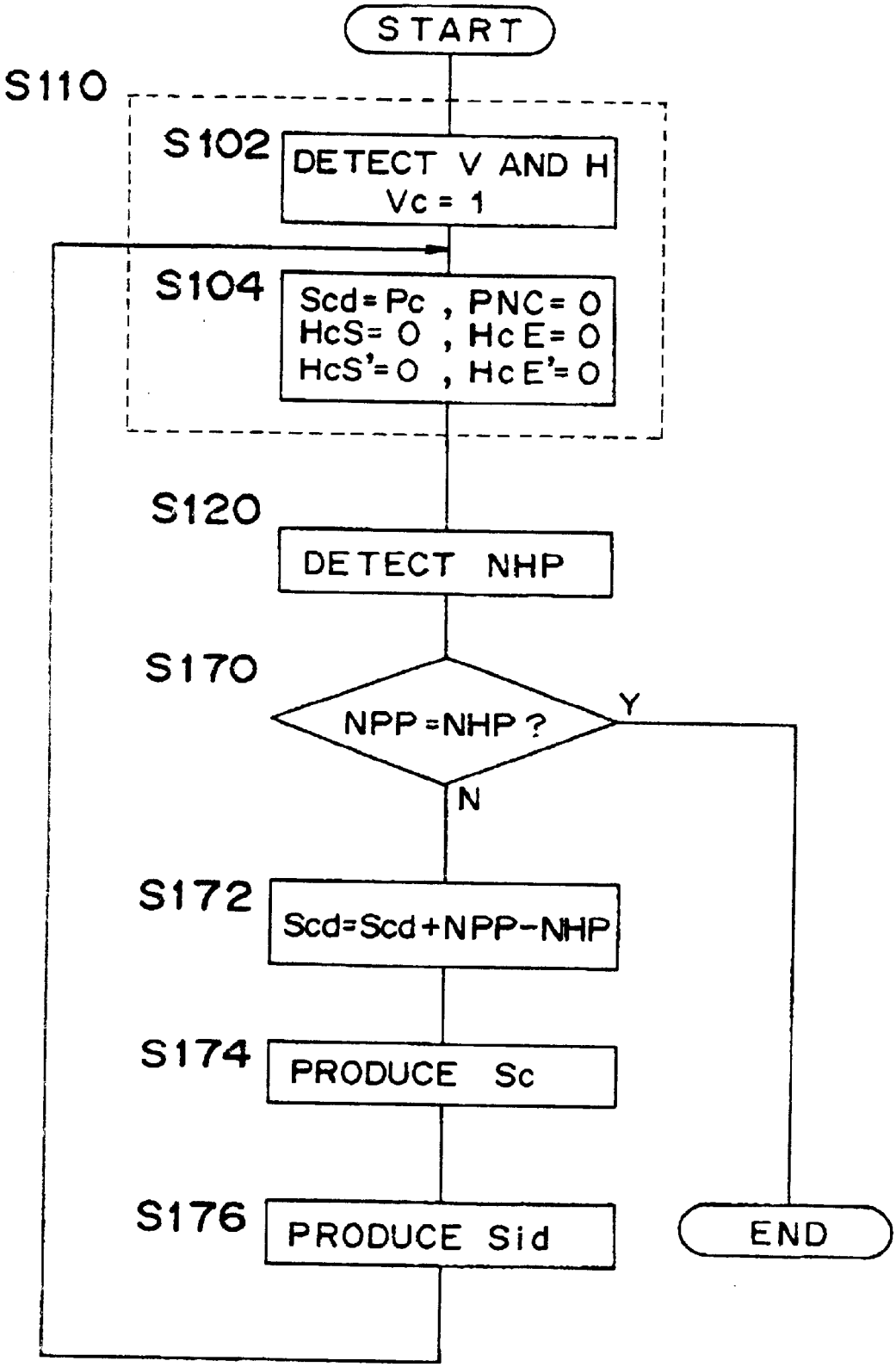
FIG. 6 is a detailed flow chart of the clock adjustment routine shown in FIG. 2.

After thus completing the effective pixel count NHP detection routine of Step S120 in FIG. 6, the procedure advances to step S170 in FIG. 6.

In step S170 the display control circuit 4 determines whether the horizontal image display period pixel count NHP read from the image information signal Si matches the preset effective display period pixel count NPP. It should be noted that the preset pixel count NPP is preferably equal to the horizontal pixel count H of the analog image signal Sia, the invention shall not to be so limited and a different appropriate value can be used.

If the horizontal display period pixel count NHP is equal to the preset pixel count NPP (step S170 returns YES), the clock count of the clock Sc is appropriate for the input analog image signal Sia. It is therefore not necessary to adjust the clock Sc, and the process terminates.

However, if the horizontal display period pixel count NHP is not equal to the preset pixel count NPP (step S170 returns NO), the clock Sc must be adjusted and the procedure advances to step S172.

At step S172 the display control circuit 4 corrects and updates the current clock count data Scd by the difference between the preset pixel count NPP and the horizontal display period pixel count NHP. The updated clock count data Scd is then output to the clock generation circuit 2, and the procedure advances to step S174.

The updated clock count data Scd is obtained from the following equation.

$$Scd=Scd+NPP+NHP \quad [2]$$

Based on the clock count data Scd input from the display control circuit 4, the clock generation circuit 2 generates a new clock Sc in step S174 and outputs to the A/D converter 1. The procedure then advances to step S176.

Based on the updated clock Se the A/D converter 1 generates the digital image signal Sid from the input analog image signal Sia in step S176. Using the generated digital image signal Sid, the image start/termination coordinate detection circuit 3, display control circuit 4, and clock generation circuit 2 repeat steps S120, S170, S172, S174, and S176.

When the preset pixel count NPP matches the detected effective pixel count NHP in step S170, the clock count data Scd generation (clock adjustment) routine of step #300 in FIG. 2 is completed and the procedure advances to step #200.

The clock count data (clock frequency) can thus be automatically calculated and adjusted.

As described above the image start/termination coordinate detection circuit 3 detects the coordinates of the left image edge pixel PS and the right image edge pixel PE as the image start and image and coordinates of the overall screen image FI by detecting and storing the coordinates of the line image starting pixel PS' and the line image ending pixel PE' every horizontal line, and then at the next line comparing the line image starting pixel PS' and the line image ending pixel PE' coordinates with the coordinates detected on the previous line. Note, however, that these coordinates can also be detected by the method described below.

In this method a clock counter PNC for counting the clock Sc triggered by the horizontal synchronization signal Hsync is connected to a left image edge pixel PS coordinate register and minimum value comparator, and a right image edge pixel PE coordinate register and maximum value comparator. When an analog image signal Sia is present the minimum and maximum value comparators operate to detect the smallest value in the left image edge pixel coordinate register and the greatest value in the right image edge pixel coordinate register.

It is also possible to determine the preset pixel count NPP in the effective horizontal display period HEDP using a counter that counts the horizontal synchronization signals in two vertical synchronization signals (i.e., detects the total number of horizontal synchronization signals in one screen, and a comparator that compares this total line count with a preset value.

This method can be used because the number of pixels in one image is generally constant for each video adapter output mode. For example, a VGA video adapter outputs 640 H×480 V pixels, an SVGA video adapter outputs 800 H×600 V pixels, and an XGA video adapter outputs 1024 H×768 V pixels. The total horizontal synchronization signal count is related to the vertical pixel count V. This means that by detecting the total horizontal synchronization signal count and comparing this count with two threshold values N1 and N2, it is possible to determine whether the video adapter is a VGA, SVGA, or XGA video adapter, or whether a multimode video adapter is operating in a VGA, SVGA, or XGA mode. For convenience, therefore, the output mode of each of these video adapters is below referenced using the common name of the video adapter type, i.e., VGA mode, SVGA mode, or XGA mode.

The value of N1 below is defined as 600 or 600 plus a known number of lines in a blanking period containing no video signals, and N2 is defined as 768 or 768 plus a known number of blanking lines. As a result, if the total horizontal synchronization signal count is less than or equal to N1, the video adapter is determined to be operating in the VGA mode; if greater than N1 and less than N2, the video adapter is determined to be operating in the SVGA mode; and if greater than or equal to N2, the video adapter is determined to be operating in the XGA mode. As a result, if the video adapter is operating in the VGA mode, the preset pixel count NPP is 640; if operating in the SVGA mode, the preset pixel count NPP is 800; and if operating in the XGA mode the preset pixel count NPP is 1024.

This comparison function is provided in the image start/termination coordinate detection circuit 3, and the result is output to the display control circuit 4. It is also possible to provide those functions requiring high speed processing, including the counter function detecting the total horizontal synchronization signal Hsync count and the comparator function, in the image start/termination coordinate detection circuit 3, and use the display control circuit 4 to discriminate the video adapter output mode and set the preset pixel count NPP.

Figure 8:
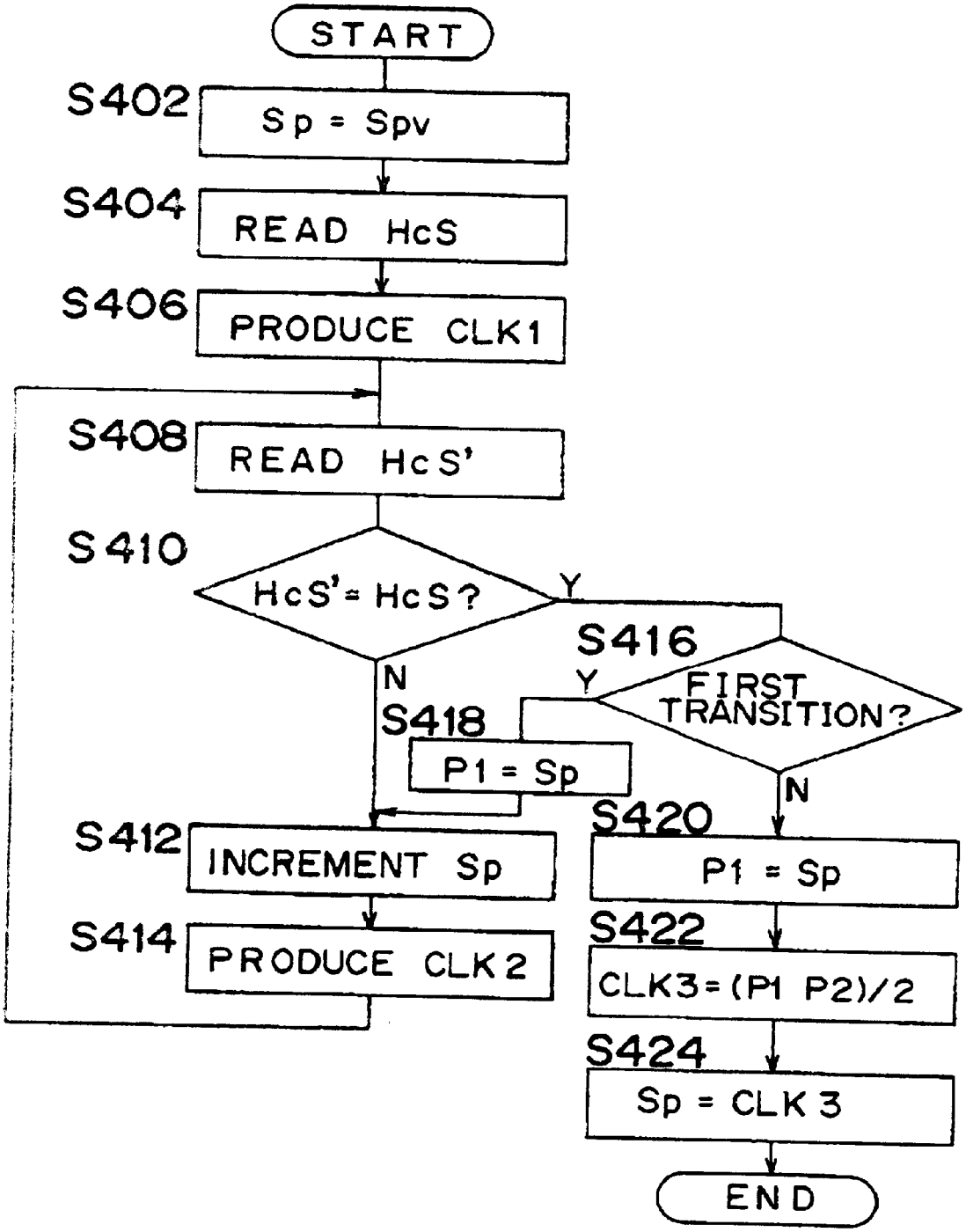
FIG. 8 is a detailed flow chart of the phase adjustment routine shown in FIG. 2.

The phase adjustment routine of step #200 in FIG. 2 is described next below with reference to FIG. 5 and FIG. 8. The concept of the phase adjustment process of the present invention is described first with reference to FIG. 5. Specific operation is then described with reference to FIG. 8.

Figure 5:
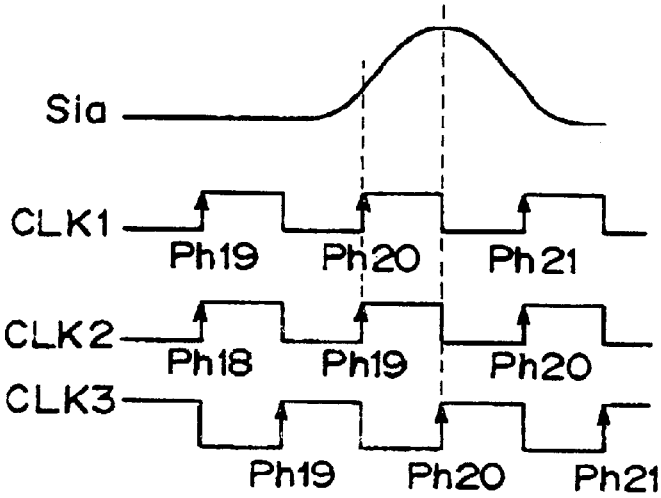
FIG. 5 is a waveform diagram used to describe phase adjustment by the present invention.

The analog image signal Sia, and clock CLK1, CLK2, and CLK3, are shown in FIG. 5. Phase adjustments i.e., generating the phase data Sp, in the present invention is accomplished using the first horizontal video signal, i.e., the horizontal image start coordinate HcS of the left image edge pixel PS, in the current digital image signal Sid.

More specifically, the twentieth clock pulse Ph20 in clock CLK1 indicates the starting edge Se of the analog image signal Sia, and the value of the left horizontal line image coordinate HcS' at this time is 20. The phase is changed from this state by shifting clock CLK1 to the right. Clock CLK2 results when the phase of clock CLK1 is shifted 360 degrees right. At clock CLK2 the starting edge Se of the analog image signal Sia is detected at the nineteenth clock pulse Ph19 and the value of the left horizontal line image coordinate HcS' at this time is 19. The clock adjusted so that the starting edge Se of the analog image signal Sia is positioned at the edge between clock pulse Ph20 and clock pulse. Ph19 is clock CLK3. The phase of clock CLK3 is thus shifted 180 degrees to the phase of clock CLK1 and clock CLK2, and the phase of clock CLK3 is thus precisely half way between clock CLK1 and clock CLK2.

Phase adjustment is thus accomplished in the present invention by shifting the phase of the clock Sc and generating two clocks CLK1 and CLK2. The phase of clock CLK1 and the phase of clock CLK2 are then detected by determining the coordinates of the starting edge Se of the analog image signal Sia at clock CLK1 and clock CLK2, respectively. Another clock CLK3 is then generated such that the phase of this clock is the midpoint between clock CLK1 and clock CLK2.

The specific process executed in step #200 for phase adjustment is described next below with reference to FIG. 8. It should be noted that the clock Sc has already been correctly adjusted according to the input analog image signal Sia by the clock adjustment routine (step #100) preceding the phase adjustment routine. The analog image signal Sia also inputs a signal in which an image is present at the left edge of the screen, i.e., the analog image signal Sia has pixel Pa or Pc shown in FIG. 4.

The display control circuit 4 outputs phase data Spv as the initial phase data Sp value to the delay circuit 5 in step S402. Note that phase data Spv indicates the shortest delay time. The procedure then advances to step S404.

At step S404 the display control circuit 4 reads the horizontal image start coordinate HcS from the image start/termination coordinate detection circuit 3, and the procedure advances to step S406. Note that the horizontal image start coordinate HcS is read using the same method executed in the horizontal image display period HP detection routine described in detail above with reference to FIG. 7.

Based on the horizontal image start coordinate HcS read in step S404, the display control circuit 4 increments the phase data Sp, thus increasing the delay time in step S406, and outputs the clock CLK1. The procedure then advances to step S408.

The left horizontal line image coordinate HcS' is then read in step S408, and the procedure advances to step S410.

Whether the left horizontal line image coordinate HcS' just read is equal to the previously read horizontal image start coordinate HcS is determined in step S410. If HcS' does not equal HcS, NO is returned and the procedure advances to step S412.

The phase data Sp from clock CLK1 is incremented again in step S412 to generate clock CLK2. The procedure then advances to step S414.

The clock CLK2 is output to the delay circuit 5 in step S414, and the procedure then loops back to step S408.

If step S410 returns YES, i.e., if the current left horizontal line image coordinate HcS' equals the horizontal image start coordinate HcS previously detected, the procedure advances to step S416.

Whether the horizontal coordinate i.e., the phase data, has changed for the first time, is determined in step S416. If YES, the procedure advances to step S418.

The phase data Sp is then stored to variable P1 in step S418, and the procedure advances to step S412. The loop of steps S412, S414, S408, and S410 detecting a phase data change is then repeated.

If step S416 returns NO, i e., step S410 has twice returned YES, the phase data Sp based on clock CLK2 and corresponding to the second detected phase data change is stored to variable P2 in step S420. The procedure then advances to step S422.

The average of variables P1 and P2, i.e., the average ((P1+P2)/2) of the two cached phase data Sp values is obtained in step S422 to determine the phase of the phase-adjusted clock CLK3. The procedure then advances to step S424.

The phase data Sp of the clock CLK3 generated in step S422 is then output to the delay circuit 5 in step S424, producing CLK3 and the phase adjustment routine ends.

Waviness in the displayed image can thus be eliminated by calculating and adjusting the phase data Sp controlling the timing for A/D conversion of the analog image signal Sia.

It should be noted that while the left edge of an image is used for the phase adjustment routine described above, it will be obvious that the same adjustment can be accomplished using the line end coordinates at the right edge of an image. In this case the image (line) end coordinates from the image start/termination coordinate detection circuit 3 are used.

Figure 9:
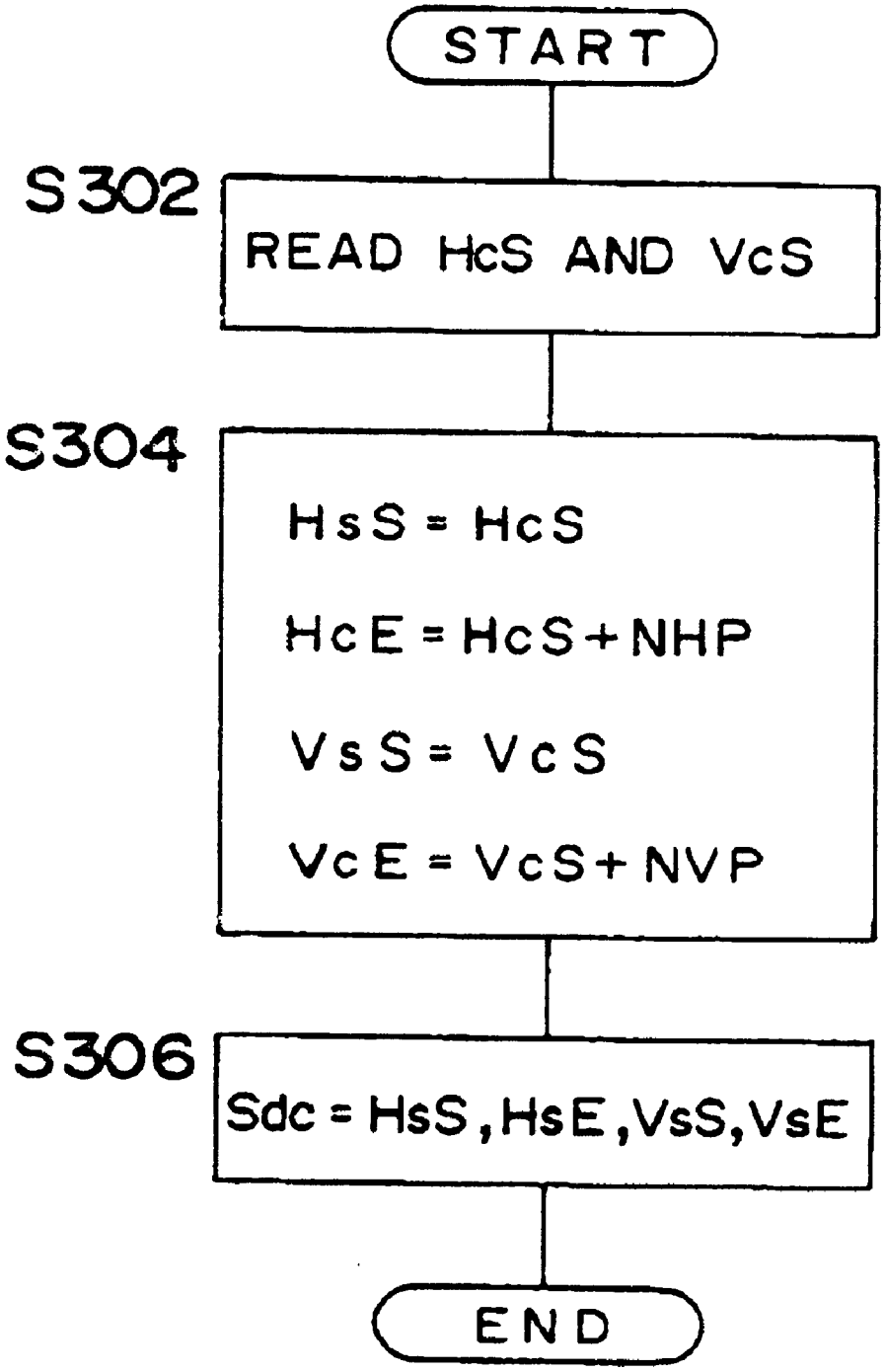
FIG. 9 is a detailed flow chart of the display position adjustment routine shown in FIG. 2.
Figure 10:
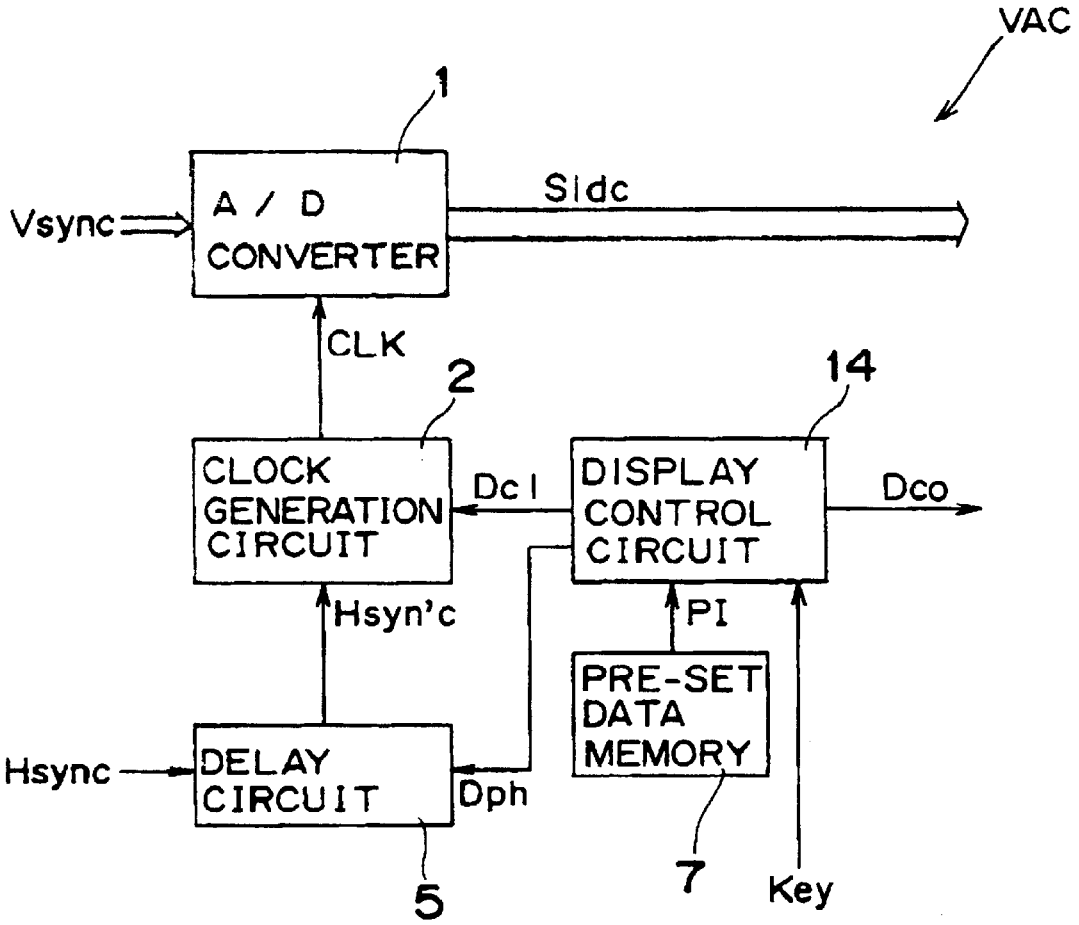
Fig. 10 PRIOR ART
FIG. 10 is a block diagram of a conventional input video adapter.
Figure 11:
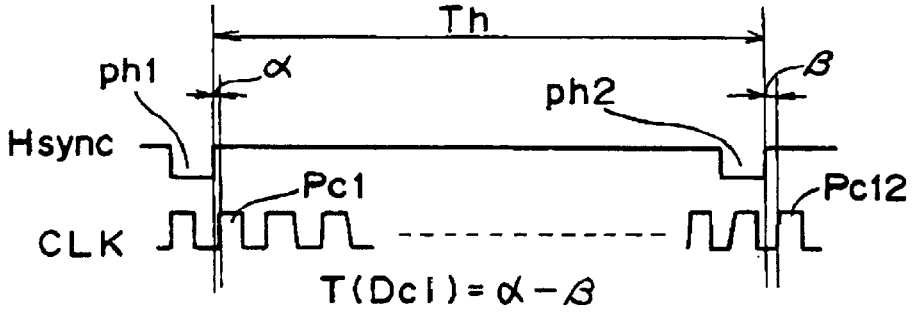
FIG. 11 is used to describe the clock adjustment problem specific to the conventional input video adapter.
Figure 12:
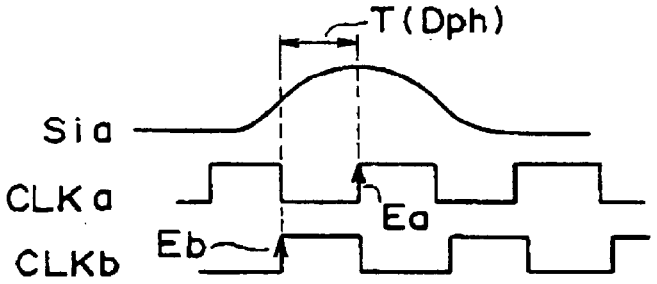
FIG. 12 is used to describe the phase adjustment problem specific to the conventional input video adapter.
Figure 13:
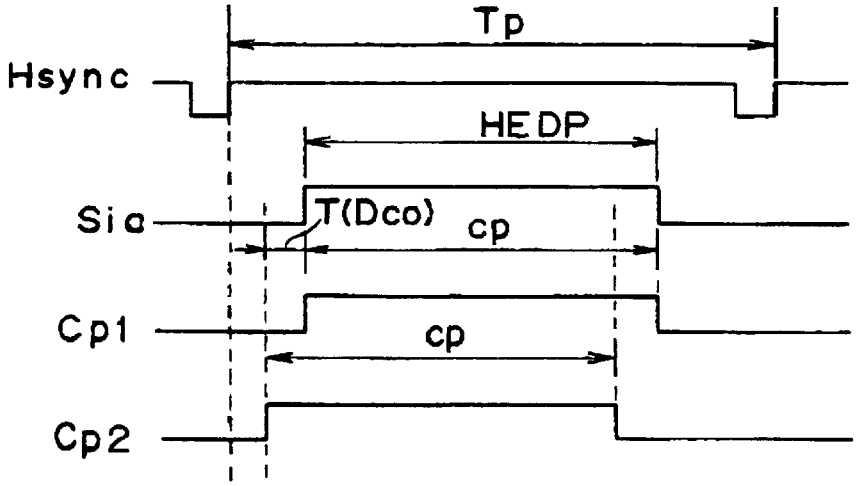
FIG. 13 is used to describe the display position adjustment problem specific to the conventional input video adapter.

The display position adjustment routine of step #300 in FIG. 2 is described next below with reference to the flow chart in FIG. 9. It will be obvious that before the display position adjustment routine begins the clock Sc and phase data Sp have already been correctly adjusted according to the input analog image signal Sia in the preceding steps #100 and #200 described above. The input analog image signal Sia also contains an image at the top left corner, i.e., contains a pixel corresponding to the corner pixel 1 Pa shown in FIG. 4.

In addition to the functions described in the clock adjustment and phase adjustment operations above, the image start/termination coordinate detection circuit 3 further comprises a function for detecting the beginning of the image in the vertical direction. It should be further noted that this vertical image start position detection function can be achieved in software, and no special circuits or other hardware means for this purpose are shown in the figures.

The vertical image starting position is also determined by detecting the vertical coordinate of the top edge of the screen image FI, i.e., by determining the vertical image start coordinate VcS. To detect the vertical image start coordinate VcS, the image start/termination coordinate detection circuit 3 counts the horizontal synchronization signals Hsync triggered by the vertical synchronization signal Vsync to detect the vertical position parameter (vertical coordinate) Vc. The first vertical position parameter (vertical coordinate) Vc at which the analog image signal Sia is detected is defined as the vertical image start coordinate VcS.

The process executed by each step of this operation is described below.

At step S302 the display control circuit 4 reads the horizontal image start coordinate HcS and vertical image start coordinate VcS from the image start/termination coordinate detection circuit 3. The procedure then advances to step S304.

The display device control data Sdc is generated based on the horizontal image start coordinate HcS and vertical image start coordinate VcS values at step S304. The process for generating the display device control data Sdc is described below.

The horizontal image start coordinate HcS at the left image edge is defined as the horizontal display start coordinate HsS. The horizontal display period pixel count NHP representing the number of pixels in the effective horizontal display period HEDP is added to the horizontal image start coordinate HcS to calculate the horizontal image termination coordinate HcE. The vertical image start coordinate VcS at the top image edge is defined as the vertical display start coordinate VsS. The vertical image display period pixel count NVP representing the pixel count in the effective vertical display period VEDP is added to the vertical image start coordinate VcS to calculate the vertical image termination coordinate VcE at the bottom image edge. Note that the vertical image display period pixel count NVP can be determined using the same method used to determine the horizontal pixel count NHP, and further description thereof is thus omitted.

After the display device control data Sdc is thus generated in step S304, the procedure advances to step S306.

The display device control date Sdc comprising the horizontal image termination coordinate HcE and vertical image termination coordinate VcE generated in step S304 is then output to the image display driving circuit 10 in step S306, and the procedure ends.

It should be noted that the horizontal image termination (right edge) coordinate HcE and vertical image termination (bottom edge) coordinate VcE are calculated from the horizontal image start (left edge) coordinate HcS and effective horizontal display period HEDP, and the vertical image start (top edge) coordinate VcS and effective vertical display period VEDP, respectively, in the above example. The display device control data Sdc can also be generated, however, using an input analog image signal Sia having effective display pixels Pa and Pd at the top left and bottom right corners of the screen image FI, and detecting the horizontal image termination (left edge) coordinate HcE and vertical image termination (bottom edge) coordinate VcE from the image start/termination coordinate detection circuit 3.

In this case the image start/termination coordinate detection circuit 3 further comprises a function for detecting the vertical image termination position. To detect the vertical image termination position the horizontal synchronization signal Hsync is counted triggered by the vertical synchronization signal Vsync to detect the vertical position parameters (coordinates) Vc, and store the last vertical coordinate Vc at which the analog image signal Sia is detected to obtain the vertical image termination (bottom edge) coordinate VcE. The image start/termination coordinate detection circuit 3 detects the horizontal image start coordinate HcS and vertical image start coordinate VcS, and the horizontal image termination coordinate HcE and vertical image termination coordinate VcE. Based on these values the display control circuit 4 then generates the display device control data Sdc and outputs to the image display driving circuit 10.

It will be obvious that a signal comprising effective display pixels Pb and Pc at the top right and bottom left corners of the screen image FI as shown in FIG. 4 can also be used as the input analog image signal Sia.

The present invention thus described does not normally require a special screen image to correctly generate the display coordinate control data used to adjust the image display position. For example, an input image covering the screen with so-called wallpaper under the Windows(®) (registered trademark of Microsoft Co.) environment can be used.

The horizontal image display period pixel count NHP and the vertical image display period pixel count NVP can also be detected using a counter and a comparator as follows. The counter counts the horizontal synchronization signals Hsync as described above in the clock count data calculation to detect the total horizontal synchronization signal count in one screen. The comparator then compares this count with a predefined value to detect the display mode as also described above. If the VGA mode is detected the pixel count of the effective horizontal display period is set to 640 and the pixel count of the effective vertical display period is set to 480. If the SVGA mode is detected the horizontal pixel count is set to 800 and the vertical pixel count to 600, and if the XGA mode is detected these values are 1024 and 768, respectively. In this case the required image area only needs to have an effective display pixel Pa at the top left corner as shown in FIG. 4. It is then only necessary to detect the horizontal image start (left edge) coordinate HcS and vertical image start (top edge) coordinate VcS, and add the horizontal and vertical pixel counts to these coordinate values, to calculate the display device control data Sdc.

It should also be noted that while the method described above applies to monochrome images, the method used to process color images differs only as follows.

Specifically, three A/D converters 1 corresponding to red (R), green (G), and blue (B) are required. The AND of these three A/D converters is then obtained and output to the image start/termination coordinate detection circuit 3 as the digital image signal Sid. The other circuits are as described above, and other than the A/D converters it is not necessary to provide separate means for each color.

It is therefore possible by means of the invention thus described to automatically set the clock count data, phase data, and display position data according to the input video (image) signal without providing predefined data for the analog image input signals from a personal computer. Manual data adjustment by the user is therefore also unnecessary.

As will be known from the preceding description of the preferred embodiment of the invention, a video adapter according to the present invention can detect the image start and end coordinates of a digitized video (image) signal, and using this data can set clock count data, phase data, and display position data matching the actual condition of the input image signal. It is therefore not necessary to provide preset adjustment data for the various video signals that may be supplied to the video adapter. As a result it is also not necessary for the user to manually adjust the offset between the input video (image) signal and the preset data PI.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A display device with a display adjustment apparatus that converts an analog image input signal to a digital signal for display, comprising:

an A/D converter that converts the analog image input signal to a digital signal, based on an input analog-digital conversion clock signal, an image start/termination coordinate detection circuit that detects a horizontal image start coordinate and a horizontal image termination coordinate in a horizontal line, based on the analog-digital conversion clock signal input from the A/D converter, a horizontal synchronization signal and a vertical synchronization signal, which are synchronized to the analog image input signal and the digital signal output from the A/D converter, a display control circuit that calculates clock count data, which is related to a frequency of the analog-digital conversion clock signal of the A/D converter, from the horizontal image start coordinate and the horizontal image termination coordinate, and a clock generation circuit that generates the analog-digital conversion clock signal input to the A/D converter, based on the clock count data input from the display control circuit, wherein the display control circuit automatically adjusts the frequency of the input analog-digital conversion clock signal by:

(a) detecting the horizontal image start coordinate and the horizontal image termination coordinate of a horizontal line by the image start/end coordinate detection circuit;

(b) comparing the detected horizontal image start coordinate on a M-th horizontal line with a previous horizontal image start coordinate on a preceding horizontal line, serving as a reference coordinate, and selecting the smaller one as a first reference comparison coordinate for a next horizontal line;

(c) comparing the detected horizontal image termination coordinate on the M-th horizontal line with a preceding horizontal image termination coordinate on the preceding horizontal line, and selecting the larger one as a second reference comparison coordinate for the next horizontal line;

(d) calculating a difference NHP between the first reference comparison coordinate and the second reference comparison coordinate;

(e) comparing the difference NHP with a predetermined effective horizontal display pixel number NPP of the display image to obtain a predetermined value;

(f) applying the clock count data to the clock generation circuit to vary a clock pulse number in accordance with the predetermined value, and returning to (a), above, in the next frame, when the predetermined value is inconsistent, and (g) ending the automatic adjusting of the frequency of the analog-digital conversion clock signal when the predetermined value is consistent.

2. The display device with a display adjustment apparatus VA according to claim 1 wherein the image start/termination coordinate detection circuit further comprises a function for counting the total number of horizontal synchronization signals between vertical synchronization signals synchronized to the analog image signal, and the display control circuit automatically adjusts the frequency of the A/D conversion clock by further comprising a function for discriminating the pixel count of the effective horizontal display period referenced for A/D conversion of the analog image signal.

3. The display device with a display adjustment apparatus according to claim 2, wherein said display coordinate is automatically adjusted by defining said pixel count of the effective horizontal display period referenced for A/D conversion of said analog signal discriminated from said total number of horizontal synchronization signals counted between said vertical synchronization signals synchronized to said analog image as said pixel count of said effective horizontal display period referenced for A/D conversion of the analog image signal, and using said total number of horizontal synchronization signals counted between said vertical synchronization signals synchronized to said analog image to discriminate a number of lines in said effective vertical display period referenced for A/D conversion of the analog image signal, and defining said number of lines as the number of lines in an effective vertical display period for A/D conversion of said analog image signal.

4. A display device with a display adjustment apparatus that converts an analog image input signal to a digital signal for display, comprising:

an analog/digital converter that converts the analog image input signal to a digital signal, based on an input analog-digital conversion clock signal, an image start/termination coordinate detection circuit that detects a horizontal image start coordinate in a horizontal period, based on the analog-digital conversion clock signal input from the analog/digital converter, a horizontal synchronization signal and a vertical synchronization signal, which are synchronized to the analog image input signal and the digital signal output from the analog/digital converter, a delay circuit that delays the horizontal synchronization signal synchronized to the analog image input signal, a clock generation circuit that generates the analog-digital conversion clock signal input to the analog/digital converter synchronized to the delayed horizontal synchronization signal output from the delay circuit, a display control circuit that outputs, to the delay circuit, phase data determining a delay time of the horizontal synchronization signal, based on the horizontal image start coordinate input to the display control circuit, wherein the display control circuit changes the phase data to detect two phase data points and at which the image start coordinate from the image start/termination detection circuit change one coordinate, and automatically adjusts a phase of the analog-digital conversion clock signal of the A/D converter.

5. A display device with a display adjustment apparatus that converts an analog image input signal to a digital signal for display, comprising:

an A/D converter that converts the analog image signal to a digital signal, based on an input analog-digital conversion clock signal, an image start coordinate detection circuit that detects a horizontal image start coordinate and a vertical image start coordinate, based on the analog-digital conversion clock signal input from the A/D converter, a horizontal synchronization signal and a vertical synchronization signal, which are synchronized to the analog image input signal and the digital signal output from the A/D converter, a display control circuit that controls a display coordinate for displaying the digital signal, wherein the display control circuit automatically adjusts the display coordinate by calculating a horizontal display start coordinate from the horizontal image start coordinate, a horizontal display end coordinate from the horizontal image start coordinate, and a pixel count of an effective horizontal display period referenced for A/ID conversion of the analog image signal, a vertical display start coordinate from the vertical image start coordinate, and a vertical display end coordinate from the vertical image start coordinate and a line count of an effective vertical display period referenced for A/D conversion of the analog image signal, and wherein the input screen is displayed from one of the top right to the bottom left corners and from the top left to the bottom right corners, the image start coordinate detection circuit further comprises a function for detecting the horizontal image termination coordinate and the vertical image termination a coordinate, and the display control circuit automatically adjusts the display coordinates by defining the pixel count of the effective horizontal display period referenced for A/D conversion of the analog image signal as the difference of the horizontal image termination a coordinate minus the horizontal image start coordinate, and defining the line count of the effective vertical display period referenced for A/D conversion of the analog image signal as the difference of the vertical image termination coordinate minus the vertical image start coordinate.

6. The display device with a display adjustment apparatus that converts an analog image input signal to a digital signal for display, comprising:

an A/D converter that converts the analog image signal to a digital signal, based on an input analog-digital conversion clock signal, an image start coordinate detection circuit that detects a horizontal image start coordinate and a vertical image start coordinate, based on the analog-digital conversion clock signal input from the A/D converter, a horizontal synchronization signal and a vertical synchronization signal, which are synchronized to the analog image input signal and the digital signal output from the A/D converter, a display control circuit that controls a display coordinate for displaying the digital signal, wherein the display control circuit automatically adjusts the display coordinate by calculating a horizontal display start coordinate from the horizontal image start coordinate, a horizontal display end coordinate from the horizontal image start coordinate, and a pixel count of an effective horizontal display period referenced for A/D conversion of the analog image signal, a vertical display start coordinate from the vertical image start coordinate, and a vertical display end coordinate from the vertical image start coordinate and a line count of an effective vertical display period referenced for A/D conversion of the analog image signal, and wherein said display coordinate is automatically adjusted by:

defining said pixel count of said effective horizontal display period referenced for A/D conversion of said analog image signal discriminated from a total number of horizontal synchronization signals counted between said vertical synchronization signals synchronized to said analog image signal, as a pixel count of said effective horizontal display period referenced for A/D conversion of said analog image signal, and using said total number of horizontal synchronization signals counted between said vertical synchronization signals synchronized to said analog image signal to discriminate a number of lines in said effective vertical display period referenced for A/D conversion of the analog image signal, and defining said number of lines as the number of lines in said effective vertical display period for A/D conversion of the analog image signal.

* * * * *

UNITED STATES PATENT AND TRADEMARK OFFICE

CERTIFICATE OF CORRECTION

PATENT NO. : 5,917,461

DATED : June 29, 1999

INVENTOR(S) : H. SAKAMI et al.

It is certified that error appears in the above-identified patent and that said Letters Patent is hereby corrected as shown below:

On the cover of the printed patent, at item [57], Abstract, line 15, after "circuit" insert --- , ---.

At column 20, line 36 (claim 5, line 24) of the printed patent, "A/ID" should be ---A/D---.

Signed and Sealed this

Twentieth Day of June, 2000

*Attest:*

*Attesting Officer*

Q. TODD DICKINSON

*Director of Patents and Trademarks*